US005152612A

United States Patent [19]

Shoemaker

[11] Patent Number: 5,152,612

[45] Date of Patent: Oct. 6, 1992

[54] COLLAPSIBLE ARTICLE WITH ATTACHED STORAGE POUCH

[76] Inventor: Peter J. Shoemaker, 351 Keith Ave., Pacifica, Calif. 94044

[21] Appl. No.: 812,078

[22] Filed: Dec. 19, 1991

Related U.S. Application Data

[63] Continuation-in-part of Ser. No. 749,253, Aug. 23, 1991, abandoned.

[51] Int. Cl.[5] ..... B65D 33/06

[52] U.S. Cl. ..... 383/6; 383/4; 383/40; 383/87

[58] Field of Search ..... 383/4, 6, 38, 39, 40, 383/37, 87

[56] References Cited

U.S. PATENT DOCUMENTS

| | | | |
|---|---|---|---|
| D. 265,864 | 8/1982 | Kracke | D3/43 |
| 1,305,797 | 6/1919 | Henderson | 383/40 X |
| 1,606,107 | 11/1926 | Simms | 383/4 X |
| 2,038,952 | 4/1936 | Niedorff et al. | 383/4 X |
| 2,532,778 | 12/1950 | Mintzes | 383/4 X |
| 2,682,290 | 6/1954 | Ditlea | 383/4 X |
| 3,587,698 | 6/1971 | Ritter | 383/40 X |
| 3,977,452 | 8/1976 | Wright | 383/87 X |
| 4,011,898 | 3/1977 | Hubbard | 383/4 X |
| 4,078,264 | 3/1978 | DeGennaro et al. | 383/4 X |
| 4,085,873 | 4/1978 | Schweitzer | 383/4 X |
| 4,117,874 | 10/1978 | Berenguer | 383/4 X |
| 4,375,111 | 3/1983 | Hall | 383/4 X |
| 4,404,687 | 9/1983 | Hager | 383/4 X |
| 4,516,668 | 5/1985 | Grayek | 383/4 X |
| 5,009,516 | 4/1991 | Geeck | 383/4 X |

FOREIGN PATENT DOCUMENTS

| | | | |
|---|---|---|---|
| 2026852 | 2/1980 | United Kingdom | 383/38 |

OTHER PUBLICATIONS

L'Eggs 1991 advertisement for tote bag.

*Primary Examiner*—Stephen Marcus
*Assistant Examiner*—Jes F. Pascua
*Attorney, Agent, or Firm*—Kathleen A. Skinner

[57] ABSTRACT

A combination of a collapsible article made of flexible material with an attached storage pouch in which the pouch is integrally attached to the article. The article may be a collapsible bag or an article of clothing or the like. The storage pouch has a support wall and a panel attached on three sides to the support wall which together form a pocket-like opening. A locking flap is attached on one side to the panel and at two opposite ends to the panel and to the support wall. When the pouch is in an empty position the locking flap is inside the pouch secured between the panel and the support wall. When the pouch is turned inside out, the article may be collapsed and inserted into the pouch and the locking flap may be reversed to cover the opening of the pouch and secure the article therein.

14 Claims, 4 Drawing Sheets

COLLAPSIBLE ARTICLE WITH ATTACHED STORAGE POUCH

This is a continuation-in-part of co-pending application Ser. No. 07/749,253 filed Aug. 23, 1991, now abandoned for a Collapsible Bag with Attached Storage Pouch, now abandoned.

BACKGROUND OF THE INVENTION

1. Field of the Invention

The present invention relates to the field of collapsible flexible articles which are desirably stored in a more compact form when they are not in use. The invention more particularly relates to a storage pouch integrally attached to an article such as a raincoat or jacket or a reusable permanent bag for carrying groceries, sundries, books, toys, or beach, picnic, or other items.

2. Description of the Prior Art

Virtually every type of store currently gives bags to its customers for carrying items purchased in the store. These bags have typically been made of either paper or plastic and are usually given free with the purchase. Most people regard these bags as disposable and throw them away after only one use.

With the recent concern over environmental problems, there has been an attempt to reduce the use of such disposable bags. Programs have been set up to recycle paper and plastic bags, but recycling, even while being preferred over disposal, still has a significant environmental cost. Environmental experts agree that the best course of action is for consumers to acquire durable permanent bags which can be reused indefinitely to carry items purchased by the consumer.

A variety of such permanent reusable bags have been made available. Most of these bags are made of canvas, cloth, string mesh, or a synthetic material such as nylon. Even though these bags have been heavily publicized and are often offered at discount prices, very few people currently use these reusable bags on a regular basis. Although it is believed that most people are concerned with environmental problems, the vast majority of consumers still use disposable bags because the permanent bags currently available do not provide the convenience that people require.

In order to use empty bags, which must be carried by the consumer into the store before purchase, the bags must be easily portable in an empty state. It is also necessary, especially in grocery stores, to use more than one bag to carry all purchases, so it is important to be able to carry multiple empty bags conveniently. Moreover, many types of bags, such as those made from canvas and sturdy cloth, are bulky and awkward to carry in a collapsed state. String bags, while being more compact, are not self-contained when compressed and can easily become entangled with other objects; it is difficult to carry more than one of them. Nylon bags, which are relatively stronger than the others, and are water resistant and washable, are the most convenient of the reusable bags. They can also be collapsed into a compact state, but it is necessary to confine them into a pouch or the like in order to make it convenient to carry them in a collapsed state.

One attempt to solve the portability problem has been to attach a separate pouch to the bag, for instance, to its carrying handle or to a hem along the opening of the bag. The bag may then be stuffed into this pouch, which is then secured by some kind of fastener, typcially, by either a zipper or Velcro strips. Another attempted solution to these problems has been to use a stiff material on the bottom of the bag, which can be folded up to cover a stiff pouch which is then secured by a zipper along its outer edge. However, all of these solutions, while improvements over earlier bags, still require some kind of special fastener and none of them provide an easy means for carrying multiple bags.

Thus, none of the prior art provides a strong, easiliy collapsible, reusable lightweight bag which can be easily stored when not in use in a conveniently located pouch which cannot become detached and lost and which can be easily manufactured at a low cost without additional fasteners or stiffening means and which, in addition, can be adapted to carry multiple bags.

In addition, there are many times when it is desirable to carry an article of cloting which may be needed while one is out, such as a raincoat or light jacket, but which one would like to carry in a compact form until it is needed. Separate pouches are easily misplaced and zippered or Velcro pouches attached to the article are undesirable from a manufacturing and aesthetic point of view. The present invention provides a solution to these needs.

SUMMARY OF THE INVENTION

The present invention is a combination of a collapsible article made of flexible material with a storage pouch integrally attached to the article. The article may be a bag with a bottom portion and wall portions and an open end for the insertion of items to be carried. The bag has handles which are attached near the open end and a storage pouch which is integrally attached to the bag. The storage pouch has a support wall, which may be a surface of the article itself, and a panel which is attached on three sides to the support wall and to the article so that a pocket is formed on the surface of the bag or other article. A locking flap is attached to the panel along one side and it is attached on its opposite ends to both the support wall and the panel when the pouch is in its first position; that is, when the pouch is empty, the locking flap is disposed between the support wall and the panel. When the pouch is turned inside out, the locking flap is disposed on the exterior of the pouch. The bag or other article may be collapsed and inserted into the reversed pouch and the locking strap may then be folded over to cover the opening of the pouch and secure the pouch and its contents in compact form without any additional fastening means. The size of the storage pouch may be varied from a small size which will hold a single bag to a larger pouch into which a large article of clothing or more than one bag may be placed. The invention can be adapted to provide on each bag at least two sizes of pouches for single or multiple bag storage.

Thus, it is one object of this invention to provide a compact pouch which is conveniently and permanently secured to a bag or article of clothing so that the pouch cannot become detached and misplaced. Another object of this invention is to provide a strong, lightweight, reusable bag which may have a plurality of storage pouches, one of which can be sized to hold multiple bags in a convenient container, thereby allowing one to carry enough bags to carry all of one's purchases. The design of the pouch also provides a unique means to close and secure the pouch containing the collapsed bag(s) in compact format without the need for zippers, Velcro strips or other closing mechanisms which can become damaged or lost. This invention, which can be made entirely from strong nylon, is therefore easier and less expensive to manufacture, it is very versatile and lightweight and is therefore more convenient for consumers to purchase and use.

Other advantages and objects of the invention will become apparent when it is considered in conjunction with the accompanying drawings.

DESCRIPTION OF THE PREFERRED EMBODIMENT

Figure 5:
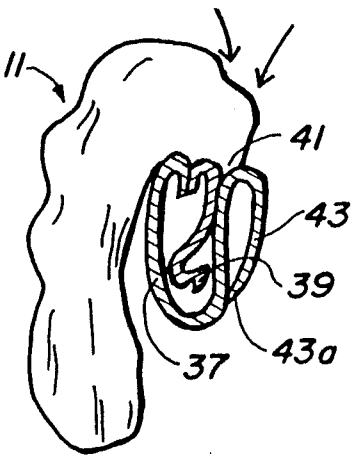
FIG. 5 is cross-sectional view taken along line 5—5 of FIG. 4.
Figure 8:
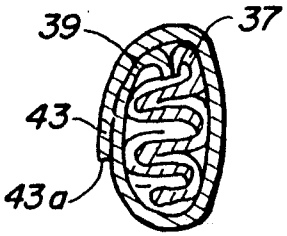
FIG. 8 is a cross-sectional view taken along lines 8—8 of FIG. 7.

The present invention is a storage pouch 13 in combination with a collapsible article made of flexible material, such as collapsible bag 11 or jacket 12. The storage pouch is attached to the article for easy storage of the bag or jacket or other article. While the storage pouch is described in greater detail herein in combination with a collapsible bag having additional desirable features, the invention also comprises the storage pouch in combination with other collapsible articles, such as lightweight jackets, raincoats, etc.

The bag 11 may be a conventional carrying bag of any size having a bottom portion 15 and wall portions 17, 19 that form an opening at their upper ends. The bag can be made from any strong flexible lightweight material so that it can be easily folded up for storage, yet be durable for carrying heavy items when in use. A synthetic fabric, such as nylon, which is also water-resistant and easily washable, is a particularly suitable fabric for the bag of this invention. The bag may be constructed from a single rectangular piece of fabric which is preferably hemmed at each end. The fabric may then be folded and the longitudinal edges can be joined together in two seams 21, 23 forming the side walls 17, 19. Short seams 25 can be sewn at each end at the bottom perpendicular to the side seams, to define a rectangular shaped bottom, if desired.

Figure 1:
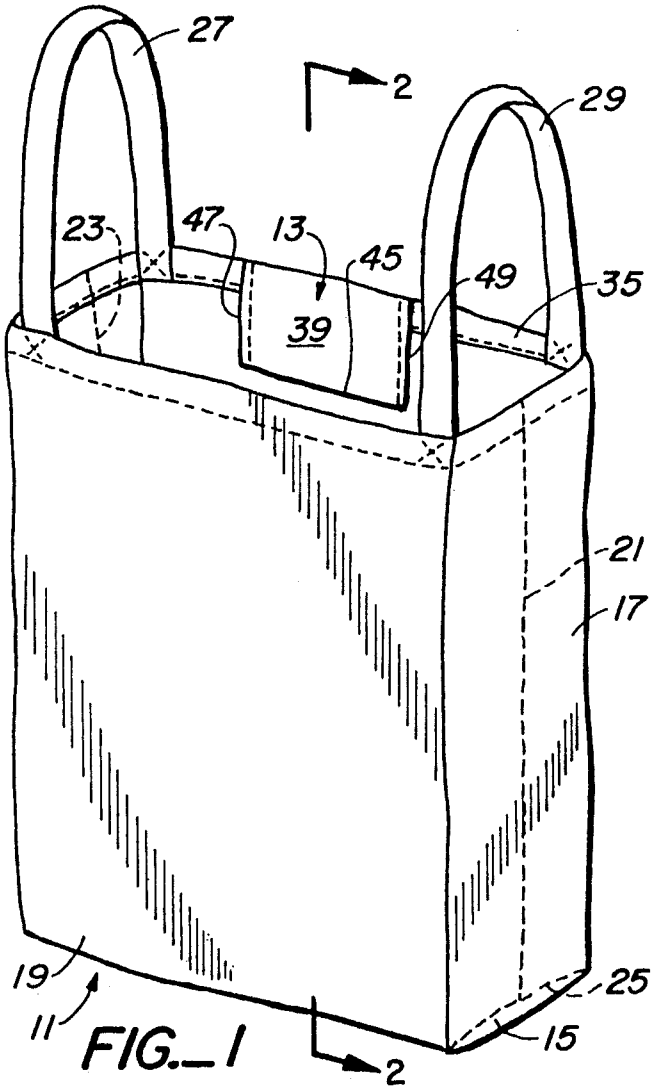
FIG. 1 is a perspective view of one embodiment of the combined collapsible article and attached storage pouch of this invention illustrating one form of the attached storage pouch with a carrying bag.

Handles 27, 29 are attached to the bag 11 near its open end. The handles may each be formed from a strip of the same fabric used for the bag and sewn together in a width manageable for carrying by hand or over the shoulder. These strap-like handles are anchored to the bag proximate the opening formed by the upper ends of the walls 17, 19 at opposed positions suitable for use in carrying the bag. The two ends of one handle may be secured to one wall of the bag or one end of a handle may be attached to one wall relatively near the side seam and the opposite end of the handle may be secured to the opposite wall in a corresponding position, as illustrated in FIG. 1.

A pair of smaller alignment handles 31, 33 opposed to each other may also be included on the bag 11. These handles, which may be attached to the exterior of the bag proximate its open end, may be loop-like handles disposed substantially parallel to the upper ends of the walls and in alignment with the top hem of the bag. These alignment handles are particularly useful for sliding onto the projections of typical bag racks at grocery stores which are used to hold disposable plastic bags open and upright while groceries are placed in the bags. The bags may then be easily slipped off the rack supports after being filled and may be carried away. Thus, this feature facilitates the packing of items in the bags, making these bags as convenient to use as the typical disposable plastic bags, but stronger. The lightweight reusable bags are conveniently stored in their empty state in an attached pouch.

Figure 2:
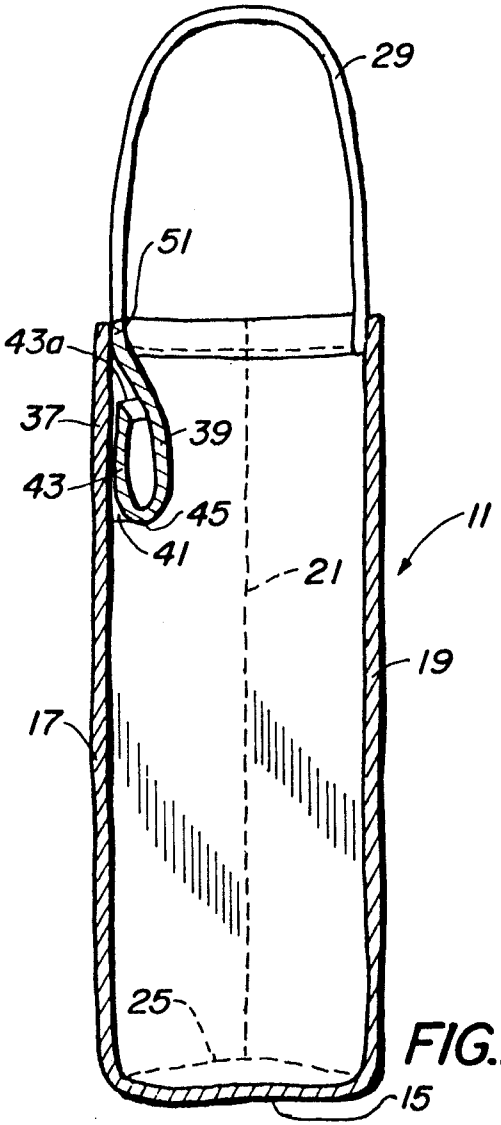
FIG. 2 is a cross-sectional view taken along line 2—2 of FIG. 1, showing the storage pouch in schematic form.
Figure 10:
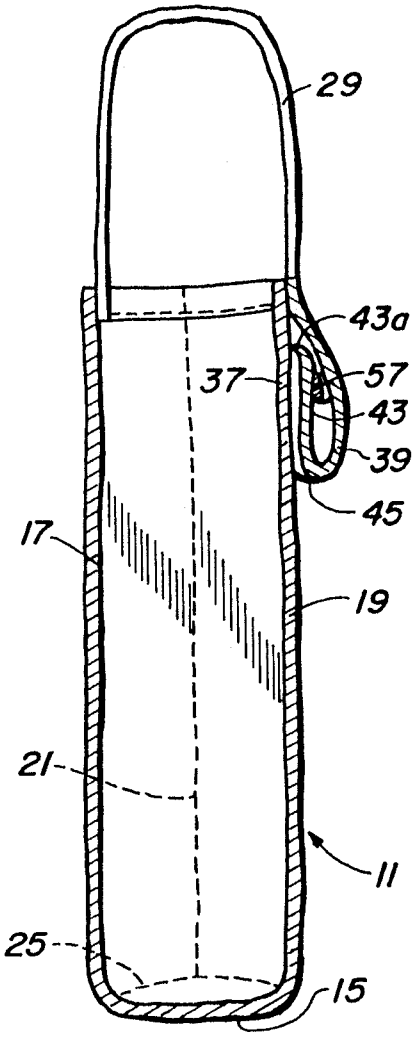
FIG. 10 is a cross-sectional view of the embodiment of FIG. 9 in schematic form.
Figure 9:
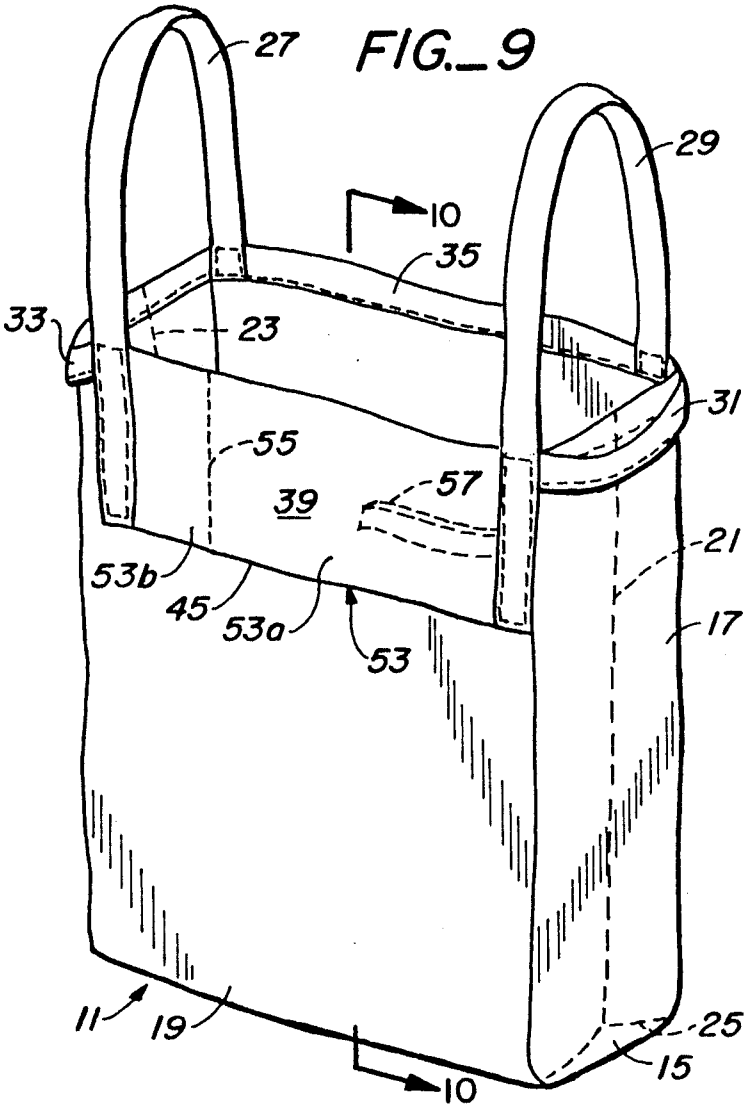
FIG. 9 is a perspective view of another embodiment of the combined pouch and carrying bag of this invention.
Figure 12:
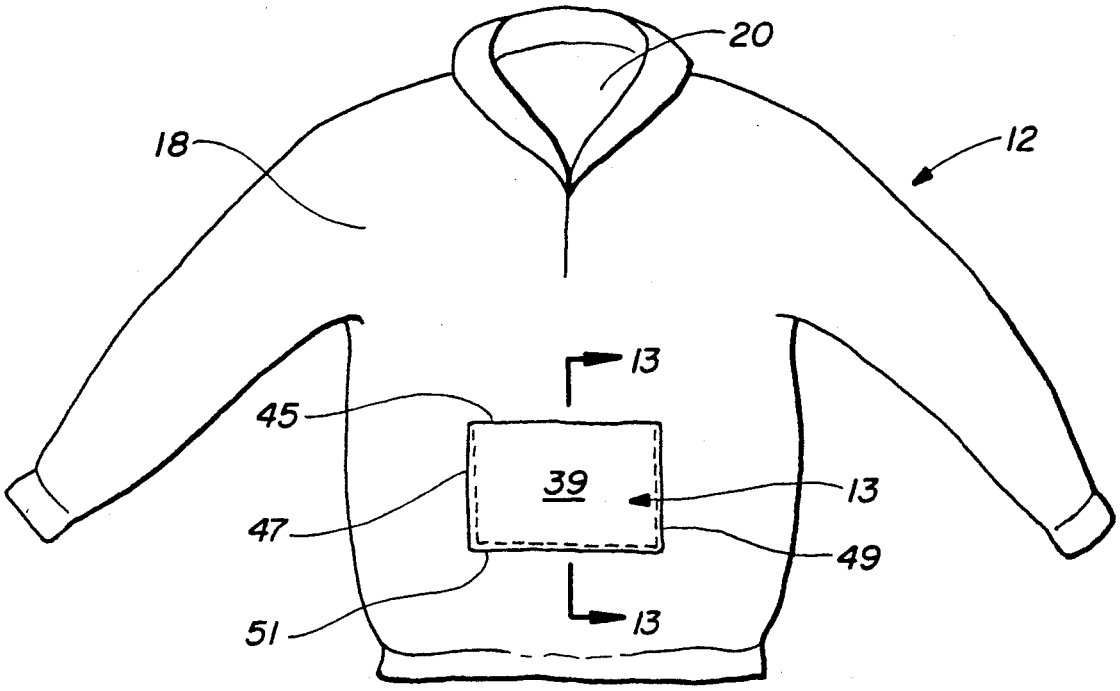
FIG. 12 is a front elevational view of another embodiment of the invention, illustrating the storage pouch integrally attached to an article of clothing.

This invention also includes an unique storage pouch 13 integrally attached to the bag 11 or other article, such as jacket 12. An article of clothing may be constructed in typical fashion and will customarily have a front surface 18 and back surface 20 and the pouch may be attached to either surface. This pouch is used to store the bag or other article, after it has been folded or compressed into a collapsed condition and inserted into the pouch, as a relatively small compact pillow-shaped container which is easy to carry in a purse or a pocket. This pouch 13 has a support wall 37 and a panel 39 attached on three sides to the support wall and to the bag 11 or other article 12 forming a pocket-like opening 41 in the opuch. A locking flap 43 is attached along its one length 45 to the panel of the pouch and it is attached at its two opposite to the panel of the pouch and it is attached at its two opposite ends 47, 49 to the support wall and the panel of the pouch. When the pouch is in a first position, as shown in FIGS. 1, 9, and 12, and the carrying bag or jacket is in its open non-compressed state, the locking flap is disposed between the support wall and the panel as can be seen by the diagrammatical illustration of FIG. 2, FIG. 10 and FIG. 13. The pouch is preferably constructed from the same type of fabric as the bag or other article. Although the pouch and locking flap may be separately constructed and then attached to the bag or article so that the support wall is coextensive with a surface of the bag itself, the pouch is preferably constructed so that a surface of the bag or other article constitutes the support wall of the pouch. The panel is a generally rectangular piece of fabric with an end portion folded inwardly toward said bag to form the locking flap. This panel 39 with an inwardly folded end portion may be attached to the bag by stitching along the opposite ends 47, 49 of the panel and along its non-folded edge 51 to form a pocket-like opening at its folded edge 41. The locking flap, which in the embodiments shown herein is the folded-over extension of the panel, is also therefore automatically anchored at its opposite ends, as well, and is disposed between the surface of the bag 11 or article 12 and the panel while the pouch is in its first (empty) position.

Figure 3:
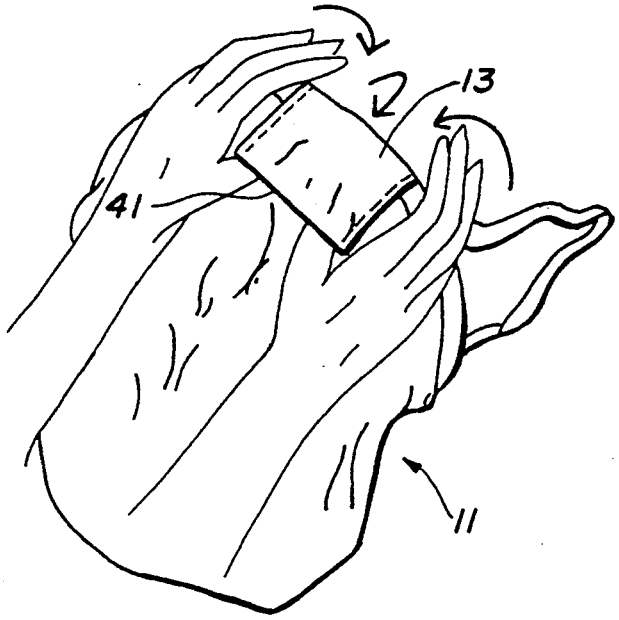
FIG. 3 is a perspective view of another embodiment of the pouch and bag of the invention, illustrating the first position of the pouch.
Figure 4:
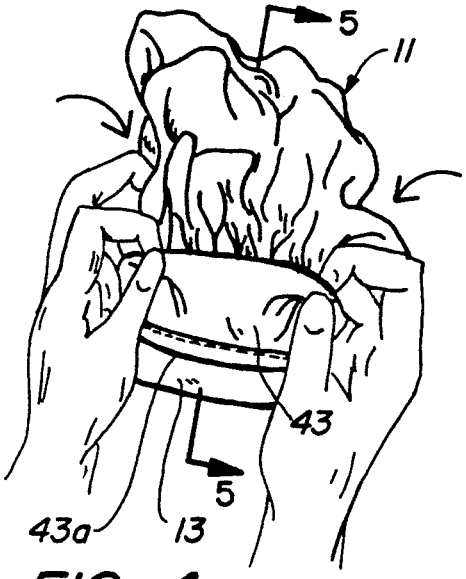
FIG. 4 is a front elevational view of the storage pouch of FIG. 3 in reversed position with the bag partially inserted therein.
Figure 6:
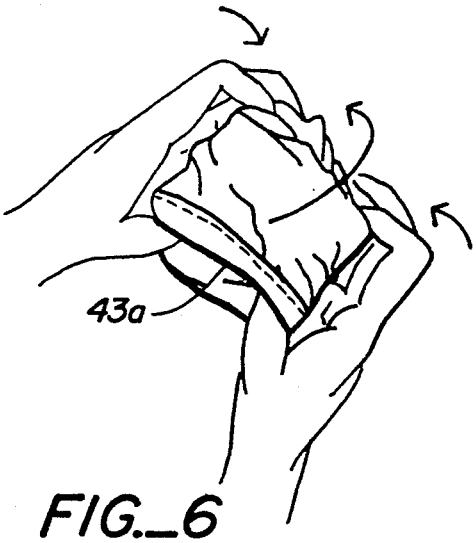
FIG. 6 is a perspective view of the storage pouch with the bag inserted therein and illustrating the manner of folding over the locking flap.
Figure 7:
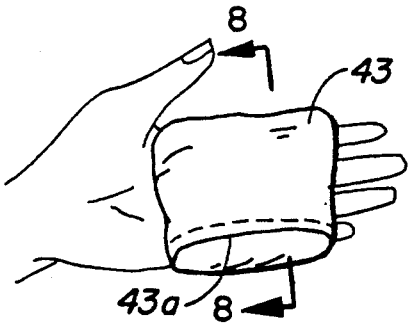
FIG. 7 is a side elevational view of the invention with the locking flap in its locked position.
Figure 11:
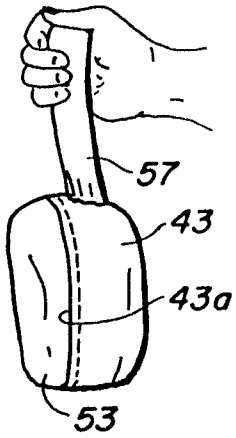
FIG. 11 is a side elevational view of the pouch of the embodiment of FIG. 9 in locked position.

When it is desired to store the carrying bag 11 or jacket 12 or other article, one can easily reverse the pouch 13 by inserting one's hands as shown in FIG. 3 into the opening 41 and turning the pouch inside out. The bag can then be compressed and stuffed into the pouch, as illustrated in FIGS. 4 and 5. When the pouch is so reversed, the locking flap 43, now disposed on the exterior of the pouch as can be seen in FIG. 4, is then folded over by turning up edge 43*a*, as illustrated in FIG. 6, to cover the opening of the reversed pouch and secure the bag in place without any additional fastening devices, such as Velcro strips or zippers. The resulting pouch containing the bag is a compact pillow-type container, as seen in FIG. 7, which can be easily carried until needed.

The unique design of this pouch 13 allows one to select any size for the pouch so long as it is at least large enough to contain the desired article in compressed state. A pouch may be made larger, however, so that two to five (or more) bags can be placed in the pouch in addition to the one to which the pouch is attached before the pouch is turned inside out and the locking flap 43 folded over. The width of the locking flap, in any case, should be at least one-half the width of the panel 39 of the pouch, the width being measured in a direction from the folded edge 45 toward the upper edge 51. Desirably, for carrying bags, two pouches are used on each bag, one sized to fit a single bag and one sized to fit multiple bags. The two pouches may be separately attached to the bag or they can be easily constructed together, as seen in FIG. 9, by sewing a single large pouch 53 onto the bag with locking flap 43 folded inwardly as described above and then stitching a seam 55 along the width of the pouch 53 to divide it into two different sized pouches 53*a*, 53*b*.

The larger-sized pouch 53*a* may also include a pouch handle 57. This handle may be a hand-sized loop formed of the same fabric from which the pouch is constructed and may be attached to the interior of the pouch when the pouch is in its first position. When a large pouch is turned inside out and the locking flap is reversed, the handle 57 provides a convenient means for carrying the pouch containing five or six reusable bags.

Figure 13:
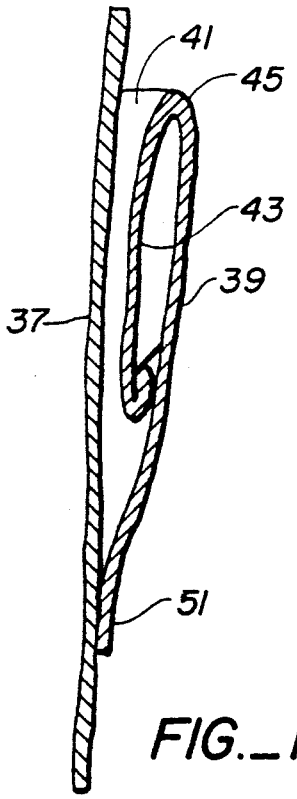
FIG. 13 is a cross-sectional view taken along line 13—13 of FIG. 12, showing the storage pouch in schematic form.

The pouch 13 (or pouches 53*a*, 53*b*) may be located inside the bag or other article as seen in FIG. 1 or outside it as in FIG. 9 and FIG. 12 and may be placed anywhere on the surface of the bag. However, the pouch is conveniently disposed on a carrying bag on the exterior of the bag proximate the opening and is centrally positioned between the handles 27, 29. The pouch 13 may be placed on either the exterior or interior of another article, such as jacket 12. The pouch may be placed in any direction on the article, as well, so that the pocket-like opening faces the lower portion of the article as seen in FIGS. 1, 2, 9 and 10, or so that it faces the upper portion of the article, as illustrated in FIGS. 12 and 13. It can be seen that the pouch of this invention can be adapted in size and location for a variety of uses and a variety of collapsible articles. The jacket or other article may be stored in compressed state in the pouch until needed.

It can be seen that the closed pouch (of either size) of this invention can be easily carried into a store, stored bag(s) can be easily removed from the storage pouch by reversing the steps described above, the alignment handles of the bag can be slipped onto the projections of bag racks at the check out counter and held upright while packed with groceries; the full bag may be carried by its carrying handles to the consumer's destination, unpacked of its contents and then easily compressed and stuffed back into its storage pouch. If necessary, the bags can be easily washed and dried before reuse.

Thus, this invention provides a solution for those persons who would like to use a reusable bag but require convenience in storing and carrying the bag. This invention provides a reusable, sturdy, yet lightweight, carrying bag which can be easily stored in a pouch which is integrally attached to it and therefore cannot be detached and misplaced. Similarly, other articles which may be used in combination with the storage pouch are advantageously stored and carried. This pouch is designed to contain the compressed bag or other article in a compact-sized container which is easy to carry and is securely locked by a reversible locking flap, rather than by extrinsic fasteners which can become detached or inoperable and which necessarily increase the cost of manufacture and the bulk and/or weight of the pouch.

This invention also uniquely solves the problem of carrying multiple bags in one pouch by providing a large pouch which can be divided into a smaller single bag sized pouch and a larger multiple bag sized pouch by a simple seam thereby making each bag and attached pouch available for storage for one or more bags, as needed.

Thus, this invention solves the needs of the prior art. It will be seen that the above-described invention will achieve all the advantages and objects attributed to it, and while it has been described in detail, it is not to be limited to such details except as may be necessitated by the appended claim.

I claim:

1. In combination with a collapsible article made of flexible material, a storage pouch integrally attached to the article, said storage pouch comprising a support wall, a panel attached on three sides to said support wall and to said article, said support wall and said panel forming a pocketlike opening, and a locking flap attached on one side to said panel and attached at two opposite ends to said support wall and to said panel, said locking flap being disposed between said support wall and said panel when said pouch is in a first position whereby when said pouch is turned inside out, said article may be collapsed and inserted into said pouch and said locking flap may be reversed to cover the opening of said pouch and secure the article therein in a compact form.

2. The storage pouch of claim 1 wherein the support wall of the storage pouch comprises a surface of the article and the locking flap is an extension of the panel, said extension being folded inwardly toward said article when the pouch is in said first position and secured at opposite ends between said panel of the pouch and said article.

3. The storage pouch of claim 1 wherein the width of the locking flap is at least one-half the width of the panel of the pouch.

4. The combination storage pouch and article of claim 1 wherein the article is a collapsible bag having a bottom portion and wall portions defining at their upper ends an open end of the bag, said bag also having handles attached to the bag proximate the open end thereof.

5. The combination storage pouch and collapsible bag of claim 4 wherein said bag is constructed primarily of a single piece of strong, lightweight fabric having a hem on at least one end of said fabric, with the side edges of said fabric joined together by longitudinal seams to form said wall portions of the bag and said pouch is disposed proximate the open end of said bag.

6. The combination storage pouch and collapsible bag of claim 4 wherein a plurality of pocket-like storage pouches are disposed on the exterior of said bag proximate the open end thereof, one of said storage pouches sized to contain more than one bag.

7. The combination storage pouch and collapsible bag of claim 5 wherein the handles are two carrying handles having their ends secured in opposed relation to each other proximate the open end of the bag, the bag further comprising a pair of smaller opposed alignment handles attached to the bag proximate its open end and substantially parallel to the upper ends of the walls.

8. The combination storage pouch and article of claim 1 wherein the article is an article of clothing having front and back surfaces and the storage pouch is attached to one of said surfaces.

9. A collapsible bag made of flexible material with attached storage pouch comprising a bag constructed of a lightweight strong material and having a bottom portion and wall portions forming at their upper ends an open end of the bag;

a pair of carrying handles secured to said bag in opposed relation proximate the open end thereof;

a reversible storage pouch integrally attached to the bag and sized to fit at least one collapsed bag, said storage pouch comprising in a first position a panel having an end portion folded inwardly toward said bag to form a locking flap, said panel being attached along three sides to a surface of the bag to form a pocket-like opening at the folded end of said panel, said locking flap being attached at opposite ends to said panel and to the surface of said bag and disposed therebetween whereby when said pouch is reversed, said locking flap will be disposed on the exterior of said pouch, said bag may be collapsed and inserted into the pouch in its reversed position and said locking flap may be folded over the opening of said reversed pouch to secure its contents.

10. The collapsible bag of claim 9 wherein said bag, said pouch, and said handles are constructed of nylon fabric and said pouch is disposed on the exterior surface of the bag proximate the open end thereof.

11. The collapsible bag of claim 9 wherein the width of said locking flap is at least one-half the width of the panel of the pouch.

12. The collapsible bag of claim 9 further comprising a plurality of storage pouches disposed on the exterior of said bag proximate the open end thereof, one of said storage pouches sized to contain more than on bag.

13. The collapsible bag of claim 9 further comprising a pair of smaller opposed alignment handles attached to the exterior of the bag proximate its open end and substantially parallel to the upper ends of said bag.

14. The collapsible bag of claim 12 wherein a pouch handle is attached to said pouch and is disposed in the interior of said pouch when the pouch is in said first position, said pouch handle being disposed on the exterior of the pouch when said pouch is in a reversed position.

* * * * *

UNITED STATES PATENT AND TRADEMARK OFFICE

CERTIFICATE OF CORRECTION

PATENT NO. : 5,152,612

DATED : October 6, 1992

INVENTOR(S) : Peter Shoemaker

It is certified that error appears in the above—identified patent and that said Letters Patent is hereby corrected as shown below:

Col. 4, lines 52 and 53, delete "to the panel of the pouch and it is attached at its two opposite".

Signed and Sealed this

Fifth Day of October, 1993

*Attest:*

*Attesting Officer*

BRUCE LEHMAN

*Commissioner of Patents and Trademarks*